United States Patent [19]

Marchay et al.

[11] 3,962,982

[45] June 15, 1976

[54] FAIRINGS FOR CABLES FOR THE TOWING OF AN IMMERSED BODY

[75] Inventors: Jean A. R. Marchay, Bourg-la-Reine; Andre Y. C. Lelievre, Meudon, both of France

[73] Assignee: Etat Francais, France

[22] Filed: Jan. 28, 1975

[21] Appl. No.: 544,681

[30] Foreign Application Priority Data

Mar. 19, 1974 France ..... 74.09161

[52] U.S. Cl. ..... 114/235 F

[51] Int. Cl.[2] ..... B63B 21/00

[58] Field of Search ..... 114/235 F, 235 B; 244/130

[56] References Cited

UNITED STATES PATENTS 3,241,513 3/1966 Rather et al. ..... 114/235 F 3,712,261 1/1973 McLelland et al. ..... 114/235 F

*Primary Examiner*—Trygve M. Blix

*Assistant Examiner*—Gregory W. O'Connor

*Attorney, Agent, or Firm*—Stevens, Davis, Miller & Mosher

[57] ABSTRACT

A first fairing element, placed around a tow cable, is truncated along its trailing edge by a bevel which is inclined to the plane of symmetry of the element. Second fairing elements on each side of the first fairing element are also truncated by bevels which are symmetrical to the plane of symmetry of the second fairing element but oppositely inclined. The truncation of the trailing edge of the fairing elements may also be defined by a surface which is symmetrical with respect to the plane of symmetry of the element and has a concavity directed outwards. The truncation may furthermore be defined by a surface perpendicular to axis of symmetry of the fairing element.

13 Claims, 3 Drawing Figures

FAIRINGS FOR CABLES FOR THE TOWING OF AN IMMERSED BODY

The object of the present invention is to provide novel cable fairings for reducing drag during the towing of immersed bodies.

The technical field of the invention is that of the structure of towing devices.

It is known that the cables which serve to tow immersed bodies, for instance sonars or exploratory or measuring devices, must be streamlined to decrease the drag of the cable, which is considerable. The drag coefficient Cx of the cable which amounts to about 1.2 without fairing may be decreased to values of between 0.2 and 0.3.

The fairings of tow cables are generally formed of successive elements which are longitudinally profiled towards the rear, that is to say in the direction of flow of the water. These fairings comprise an inner cavity through which there pass the conductors intended for the electrical connections between the towing ship and the body towed.

The successive elements of the fairing have a slight play with respect to each other, on the order of a few millimeters, so that they do not interfere with the passage of the cable over a pulling winch nor the winding up thereof on a storage drum.

There are also continuous tow cable fairings formed of a material which is elastic so that it can follow the deformations of the cable when the latter is wound on a capstan or on a storage drum.

Whatever the method of making the fairings, the towing of an immersed body pulled by a streamlined cable presents great difficulties due to the fact that the cable moves laterally out of the plane of symmetry of the vessel.

This lateral deviation of the cable leads to the fact that the immersed body tends to rise and the depth thereof can no longer be controlled, which is extremely disturbing in certain applications, particularly when it is desired to explore the bottom or the presence of immersed objects in the vicinity of the bottom.

In certain cases, the lateral deviation reaches very large values which increase the drag of the cable to such an extent that towing is no longer possible without the risk of breaking the traction cable and, in those instances, streamlined cables are not usable.

The object of the present invention is to eliminate the lateral deviation of streamlined cables.

This purpose is achieved by means of a fairing, the trailing edge of which is truncated. The truncating of the trailing edge defines, with the lateral faces of the fairing, two edges which are parallel to the cable. The fairings have a longitudinal plane of symmetry passing through the axis of the cable.

In an embodiment of the invention, the trailing edge of a fairing is truncated symmetrically with respect to the plane of symmetry of said fairing. For instance, it is truncated by a bevel perpendicular to the said plane of symmetry or else it has a truncation defined by a curved surface the concavity of which faces the outside. The truncation of the trailing edge has the effect of producing separations of the fluid streams. These separations originated on the edges located at the two ends of the truncation and the position of these separations is therefore determined with greater precision the sharper these edges are. These separations cause lateral thrusts of the fairings which have a tendency to cause the latter to pivot but, if the truncation is perfectly symmetrical, the lateral thrusts which originate on the two sides of the fairing cancel out and the cable is not deflected. However, this embodiment requires a very precise machining of the truncations. Another, simpler embodiment is preferably adopted.

In the event that the fairing is formed of identical successive elements having a longitudinal plane of symmetry and comprising stops which limit their mutual deflection, at least some of these elements comprise, along the trailing edge, truncations which are asymmetrical with respect to the said longitudinal plane of symmetry and which occupy, on two successive elements, positions which are symmetrical with respect to the said longitudinal plane of symmetry.

The truncations are preferably formed of bevels inclined symmetrically and alternately with respect to the longitudinal plane of symmetry. This embodiment is obtained, for instance, by identically bevelling identical fairing elements and turning these elements alternately around in such a manner as to cause every second element to experience a rotation of 180° around their axis of symmetry perpendicular to the cable.

This embodiment has the advantage that the truncations do not have to be made with great precision. The lateral forces which act on two successive elements and which have a tendency to pivot these two elements in opposite direction are transmitted from one element to the other via the stops and cancel each other out. It is found by experiment that the tow cable then remains in the longitudinal plane of symmetry of the towing vessel even if the bevels are not made with great precision.

The result is that these bevels may be obtained by economic means, for instance by sawing or planing the trailing edge of the fairing elements or even be produced upon the molding when the fairing elements are molded.

In the event that the fairing is formed of a single continuous deformable element having a longitudinal plane of symmetry, the trailing edge can also be truncated by successive bevels, whether or not juxtaposed, which are inclined alternately on opposite sides of the plane of symmetry by the same amount.

The result of the invention is a new improved fairing for cables for the towing of an immersed object. This fairing has the advantage that the tow cable does not deflect laterally and remains in the longitudinal plane of symmetry of the towing vessel.

This result is due to the fact that the presence of a truncation along the trailing edge does not substantially modify the lateral lifts of the fairing but rather creates moments of pivoting of the fairing elements with respect to the axis of the cable. These moments tend to move the trailing edge of each fairing element to the outside of the longitudinal plane of symmetry in such a manner that the successive elements stand out alternately on opposite sides of this plane. The movement of the water over each of these elements produces oblique thrusts which tend to cause the cable to deflect alternately on opposite sides of the longitudinal plane of symmetry of the towing vessel and these thrusts balance each other out as long as the cable remains in the plane of symmetry. As soon as it tends to move out of same, the lateral thrust which tends to return it towards the plane of symmetry increases while the other decreases.

The truncated fairings in accordance with the invention result in an increase in the drag which remains very small, namely less than 10%.

The following description refers to the accompanying drawings which show several embodiments of the invention by way of illustration and not of limitation.

Figure 1:
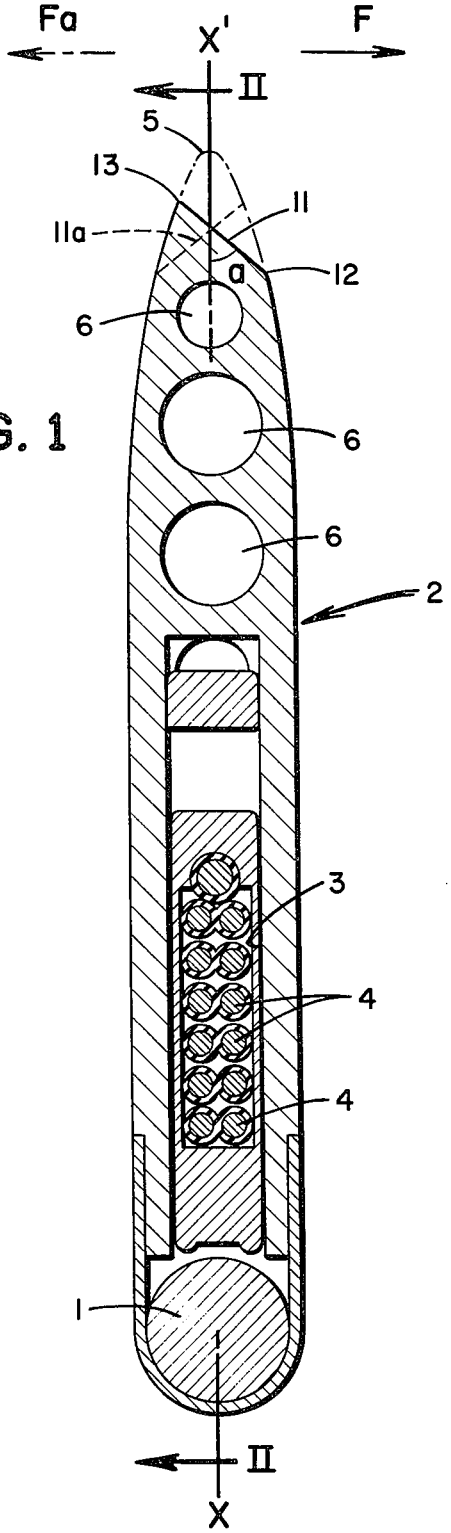
FIG. 1 is a cross section through a fairing element made in accordance with the invention.
Figure 3:
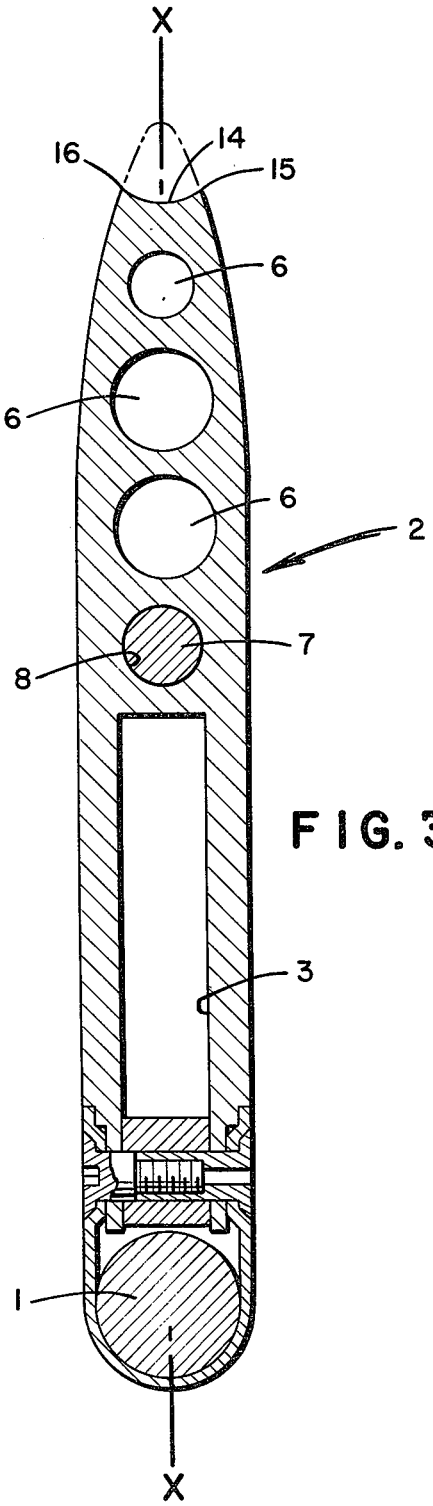
FIG. 3 is a cross section through another fairing element made in accordance with the invention.
Figure 2:
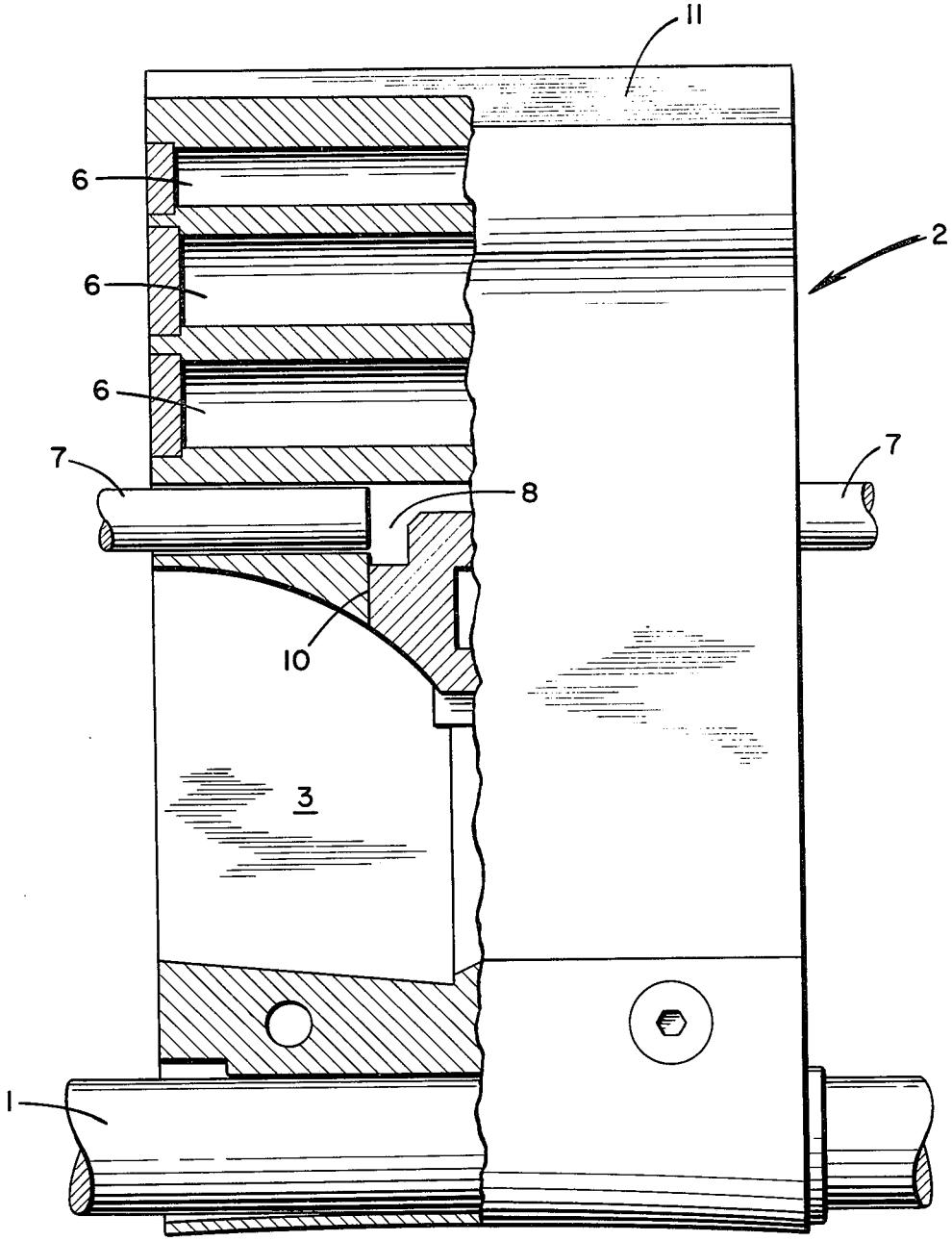
FIG. 2 is a semi-cross section along the line II—II of FIG. 1.

FIGS. 1, 2 and 3 show a tow cable 1 and a fairing element 2, at its leading edge, placed around the cable. This fairing element has in general the shape of a longitudinally profiled wing. It has a longitudinal plane of symmetry *xx'* passing through the axis of the cable. On the inside it has a hollow recess 3 through which there pass electric wires 4 connecting the towing ship to the immersed body towed. On the side of the trailing edge 5, the fairing element has cavities 6 which are closed in watertight manner and constitute floats.

Each element has a pin 7 imbedded in a bore hole 8 and engaging in a bore hole of the adjacent element until it comes into contact with a stop 10. These pins 7 limit the mutual deflection of two juxtaposed fairing elements in such a manner that there is no danger of the electric wires 4 being sheared.

Such hydrodynamic fairing elements are known. They substantially reduce the drag coefficient Cx of the cable. However, they have the drawback of frequently producing a lateral deviation of the tow cable which is thus moved outside the plane of longitudinal symmetry of the towing vessel.

In order to overcome this very serious drawback, the fairing elements in accordance with the present invention are truncated along their trailing edge 5. FIGS. 1 and 2 show for instance a truncation which consists of a bevel 11 which is oblique with respect to the plane of symmetry *xx'*.

The two juxtaposed elements on opposite sides of an element are also truncated by a plane 11*a*, shown in dashed line, which is symmetrical to the plane 11 with respect to *xx'* but oppositely inclined.

The plane 11 defines, with the lateral faces of the fairing, two sharp edges 12 and 13 along which separations of the fluid stream occur. The fairing element 2 is subjected to a moment of rotation around the axis of the cable 1 tending to cause it to pivot in the direction indicated by the arrow F. Similarly, the juxtaposed elements are subjected to moments which tend to pivot them in the direction indicated by the arrow F*a*.

As the juxtaposed elements are connected together by deflection limiters 7, the moments cancel themselves out and the fairing as a whole assumes a position of equilibrium in which each truncated element is slightly deflected alternately on the other side of the longitudinal plane of symmetry passing through the axis of the cable 1.

One may truncate only some of the fairing elements 2 or all of them.

FIG. 3 shows a different embodiment in which the truncation of the trailing edge is defined by a surface 14 which is symmetrical with respect to the plane *xx'* and has a concavity which is directed outwards in such a manner that the edges 15 and 16 produce very sharp and precisely localized separations of the fluid streams.

As a variant, the curved surface 14 can be replaced by a plane perpendicular to the axis *xx'*.

These latter embodiments, in which the truncation is symmetrical with respect to the plane *xx'*, make it possible to stabilize the cable in the plane of longitudinal symmetry of the vessel provided that they are perfectly symmetrical, which results in the necessity of very precise machining of the truncations. For this reason, the embodiment of FIGS. 1 and 2 is preferred since it leads to a good stabilization of the cable even in the event that the bevels are made without precision, for instance by sawing, planing, or are produced upon the molding.

In the embodiment shown in FIGS. 1 and 2, the angle *a* which the plane 11 makes with the plane *xx'* may be between 30° and 90°.

The longitudinal position of the bevel 11 may vary, but experience shows that the bevel should eliminate at least 5% of the total length of the profile, measured along the axis *xx'*, in order to be effective.

Of course, various equivalent changes may be made by those skilled in the art in the fairings which have been described above (solely by way of example) without thereby going beyond the scope of the invention.

We claim:

1. A new product including a fairing for a cable for towing, by a ship, an object immersed in water, the fairing comprising: a longitudinally profiled wing-shaped body having a leading edge about the cable and a trailing edge which is truncated, said body having a longitudinal plane of symmetry through the axis of the cable, a plurality of watertight cavities near said trailing edge and forming floats, a hollow recess near said leading edge to house means connecting the ship to the object, and a pin having one end imbedded in a bore hole of said body and extending outside said body.

2. A new product according to claim 1, in which the truncation of the trailing edge defines with the lateral faces of the body two sharp edges which are parallel to the cable.

3. A new product according to claim 2, in which the truncation of the trailing edge is symmetrical with respect to the plane of symmetry of said body.

4. A new product according to claim 3, in which the truncation of the trailing edge is a bevel perpendicular to the plane of symmetry.

5. A new product according to claim 3, in which the truncation of the trailing edge is a curved surface having a concavity which is directed towards the outside of the fairing.

6. A new product according to claim 11, further comprising identical successive fairings representing a longitudinal plane of symmetry and having stops for the pins which limit their mutual deflection, at least some of the fairings having, along the trailing edge, truncations asymmetrical with respect to the plane of symmetry of the fairing, adjacent fairings having trailing edges oppositely and equally asymmetrical.

7. A new product according to claim 6, wherein said truncations are formed of bevels which are inclined symmetrically and alternately with respect to the longitudinal plane of symmetry of the respective fairings.

8. A new product according to claim 7, wherein said bevels are bevelled identically and are juxtaposed with the bevels oppositely sloping.

9. A new product according to claim 1, wherein the fairing is formed of a single continuous deformable body, having the longitudinal plane of symmetry, and the trailing edge includes successive bevels inclined alternately on opposite sides of the plane of symmetry by an equal amount.

10. A method of preparing cable fairings of the type used in towing immersed objects that comprises producing a bevel on each of a number of fairings, and thereafter assembling said fairings on a cable with the bevels of adjacent fairings oppositely inclined.

11. A method according to claim 10 where the step of producing includes sawing.

12. A method according to claim 10 where the step of producing includes planing.

13. A method according to claim 10 where the step of producing includes molding.

* * * * *